US007337582B1

(12) United States Patent
Klotz

(10) Patent No.: US 7,337,582 B1
(45) Date of Patent: Mar. 4, 2008

(54) WINDOW PROTECTION SYSTEM

(76) Inventor: Ken B. Klotz, 5850 18th St., North #25, St. Petersburg, FL (US) 33714

( * ) Notice: Subject to any disclaimer, the term of this patent is extended or adjusted under 35 U.S.C. 154(b) by 427 days.

(21) Appl. No.: 11/138,779

(22) Filed: May 26, 2005

(51) Int. Cl.
*E05C 21/02* (2006.01)

(52) U.S. Cl. ..... 49/465; 49/463; 52/202

(58) Field of Classification Search ..... 49/463, 49/465; 52/202, 203; 24/545, 289, 293, 24/294, 295
See application file for complete search history.

(56) References Cited

U.S. PATENT DOCUMENTS 3,064,550 A * 11/1962 O'Day et al. ..... 454/301
3,484,994 A 12/1969 Ashby et al.
4,726,149 A 2/1988 Tryba
4,998,381 A * 3/1991 Langenhorst ..... 49/463
6,334,282 B1 1/2002 Wood
6,363,670 B1 4/2002 Dewitt

FOREIGN PATENT DOCUMENTS

FR 2577603 * 4/1986

* cited by examiner

*Primary Examiner*—Jerry Redman
(74) *Attorney, Agent, or Firm*—Edward P Dutkiewicz

(57) ABSTRACT

An anchor clip, fabricated of a resilient material, has a pair of end portions and a middle portion with a pair of intermediate portions there between. A pair of flex lines between each intermediate portion and the middle portion thereby forms an interior region. The end portions each have a coupling region with a pair of outer receivers and inner lips with a pair of openings adjacent and there between. The outer receivers each have a pair of apertures. The middle portion has four tabs that extend radially from the middle portion with each tab having a second pin aperture. A sheer pin includes a handle portion with a first short end and a second long end. The handle has a pair of sides with a center point there between.

10 Claims, 3 Drawing Sheets

FIG 3
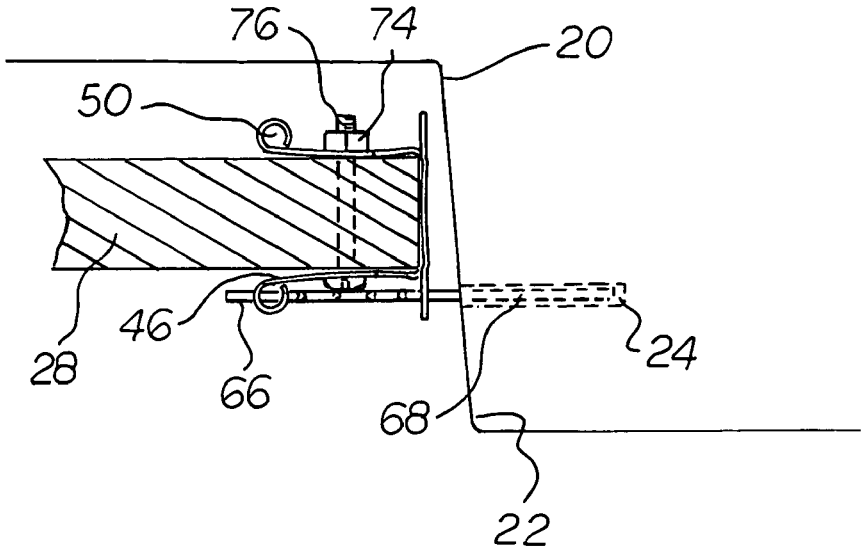
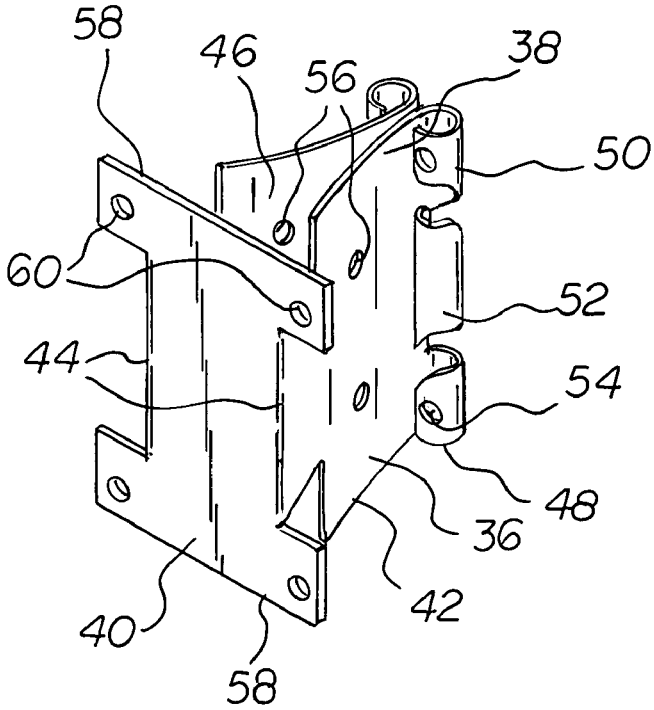
FIG 4

WINDOW PROTECTION SYSTEM

BACKGROUND OF THE INVENTION

1. Field of the Invention

The present invention relates to a window protection system and more particularly pertains to removably coupling a protective covering over a window.

2. Description of the Prior Art

The use of window protectors is known in the prior art. More specifically, window protectors previously devised and utilized for the purpose of protecting windows during hurricanes and the like are known to consist basically of familiar, expected and obvious structural configurations, notwithstanding the myriad of designs encompassed by the crowded prior art which has been developed for the fulfillment of countless objectives and requirements.

By way of example, U.S. Pat. No. 3,484,994 to Ashby et al dated Dec. 23, 1969 relates to a Door-Transom Assembly And Method Of Manufacture. U.S. Pat. No. 4,726,149 to Tryba dated Feb. 23, 1988 relates to a Fixture For Protection Of Windows. U.S. Pat. No. 6,334,282 to Wood dated Jan. 1, 2002 relates to a Device For Covering Windows And Doors During Severe Storms. Lastly, U.S. Pat. No. 6,363,670 to Dewitt dated Apr. 2, 2002 relates to a Hurricane Protection System.

While these devices fulfill their respective, particular objectives and requirements, the aforementioned patents do not describe a window protection system that allows removably coupling a protective covering over a window.

In this respect, the window protection system according to the present invention substantially departs from the conventional concepts and designs of the prior art, and in doing so provides an apparatus primarily developed for the purpose of removably coupling a protective covering over a window.

Therefore, it can be appreciated that there exists a continuing need for a new and improved window protection system which can be used for removably coupling a protective covering over a window. In this regard, the present invention substantially fulfills this need.

SUMMARY OF THE INVENTION

In view of the foregoing disadvantages inherent in the known types of window protectors now present in the prior art, the present invention provides an improved window protection system. As such, the general purpose of the present invention, which will be described subsequently in greater detail, is to provide a new and improved window protection system and method which has all the advantages of the prior art and none of the disadvantages.

To attain this, the present invention essentially comprises a window protection system for removably coupling a protective covering over a window. The system comprises, in combination, a structure including a generally rectangular opening having an upper edge and a lower edge with a pair of side edges there between. The structure also has an inner periphery and an outer periphery. The edges have a plurality of narrow apertures perpendicularly therein adjacent to the outer periphery and the structure also have a window adjacent to the inner periphery.

Next provided is an insert selected from the class of inserts including but not limited to wood, glass and polycarbonate. The insert has a generally rectangular configuration with an upper end and a lower end with a pair of side ends there between. The insert has similar yet smaller dimensions than the opening of the structure with none of the dimensions of the opening being more than 0.25 inches than the equivalent dimension of the insert. The insert is adapted to protect the window from debris and other objects tossed around by gusting winds such as those found in a hurricane.

Provided next are a plurality of anchor clips. Each clip is fabricated from a single piece of metal with resilient characteristics. Each clip has a pair of end portions and a middle portion with a pair of intermediate portions there between. Each clip also includes a pair of flex lines between each intermediate portion and the middle portion thereby forming an interior region adapted to receive the ends of the insert and held in place under the power of the metal about the flex lines. Each end portion has a generally cylindrical coupling region with a pair of outer cylinders and an inner lip with a pair of openings adjacent there between. Each outer cylinder has a pair of first coaxial pin apertures running through two sides of the outer cylinder. Each of the intermediate portions also has a pair of bolt apertures running coaxially between the adjacent intermediate portion. The middle portion has four tabs that extend radially from the middle portion with each tab having a second pin aperture. Each anchor clip has a resting orientation wherein the end portions are in contact with each other and an open orientation where the end portions are separated from each other and with the intermediate portions parallel to each other against the resilient nature of the metal.

A plurality of sheer pins are provided. Each shear pin is fabricated of metal and formed in a long narrow configuration shaped to include a handle portion, a first short end and a second long end with the first short end running coaxial to the second long end and having the handle perpendicular there between. Each handle has a pair of sides with a center point there between. The first short end is adapted to couple into the first coaxial pin apertures of the anchor clip and the second long end is adapted to couple into the second pin aperture and into apertures in the edges of the opening in the structure. In this manner, compressing the sides of the handle together shortens the distance between the first short end and the second long end thereby facilitating insertion.

Lastly, a plurality of locking nut and bolt are adapted to secure the anchor clip to the insert. The bolt passes through the bolt aperture of the anchor clip and then the insert and then through the coaxial bolt aperture and is held in place with the nut.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window protection system which has all of the advantages of the prior art window protectors and none of the disadvantages.

It is another object of the present invention to provide a new and improved window protection system which may be easily and efficiently manufactured and marketed.

It is further object of the present invention to provide a new and improved window protection system which is of durable and reliable constructions.

An even further object of the present invention is to provide a new and improved window protection system which is susceptible of a low cost of manufacture with regard to both materials and labor, and which accordingly is then susceptible of low prices of sale to the consuming public, thereby making such window protection system economically available to the buying public.

Even still another object of the present invention is to provide a window protection system for removably coupling a protective covering over a window.

Lastly, it is an object of the present invention to provide a new and improved window protection system comprising an anchor clip fabricated of a resilient material. The clip has a pair of end portions and a middle portion with a pair of intermediate portions there between. The clip also includes a pair of flex lines between each intermediate portion and the middle portion thereby forming an interior region. The end portions each have a coupling region with a pair of outer receivers and inner lips with a pair of openings adjacent and there between. The outer receivers each have a pair of apertures. The middle portion has four tabs that extend radially from the middle portion with each tab having a second pin aperture. A sheer pin includes a handle portion with a first short end and a second long end. The handle has a pair of sides with a center point there between.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred primary and alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional of the present invention taken along line 3-3 of FIG. 2.

FIG. 4 perspective illustration of the anchor clip used in the preferred embodiment of the present invention.

The same reference numerals refer to the same parts throughout the various Figures including the primary and alternate embodiments.

DESCRIPTION OF THE PREFERRED EMBODIMENT

Figure 1:
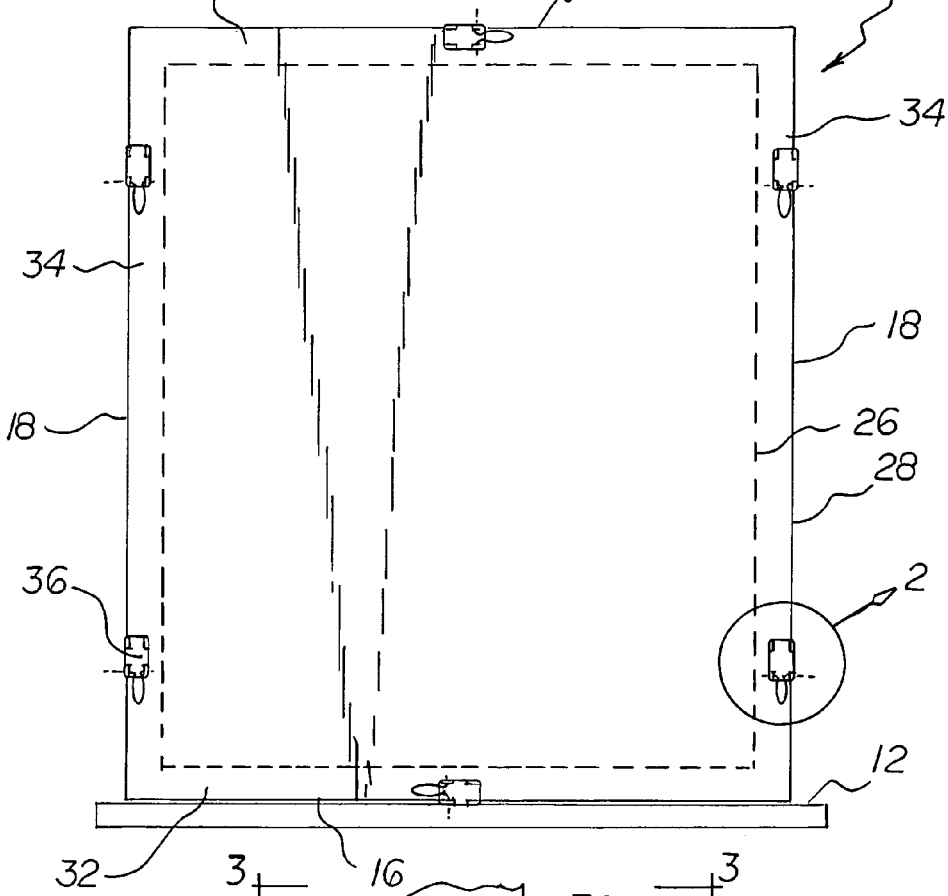
FIG. 1 is a front elevational view illustrating the preferred embodiment of the present invention.
Figure 2:
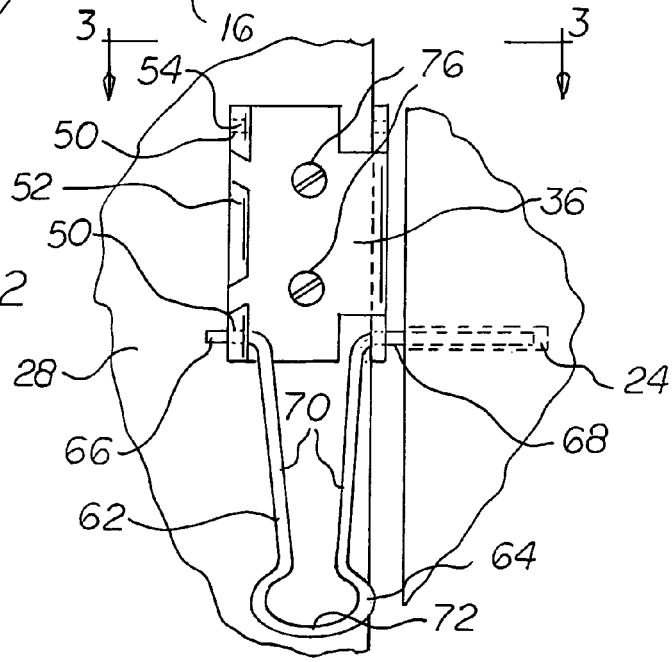
FIG. 2 is an enlarged view of the anchor clips of the present invention taken from circle 2 of FIG. 1.

With reference now to the drawings, and in particular to FIG. 1 thereof, the preferred embodiment of the new and improved window protection system embodying the principles and concepts of the present invention and generally designated by the reference numeral 10 will be described.

The present invention, the window protection system 10 is comprised of a plurality of components. Such components in their broadest context include an anchor clip and a shear pin. Such components are individually configured and correlated with respect to each other so as to attain the desired objective.

As may be seen in FIGS. 1 through 4, the present invention includes a window protection system 10 for coupling a protective covering over a window. The system comprises, in combination, a structure 12 which includes a generally rectangular opening having an upper edge 14 and a lower edge 16 with a pair of side edges 18 there between. The structure also has an inner periphery 20 and an outer periphery 22. The edges have a plurality of narrow apertures 24 perpendicularly therein adjacent to the outer periphery. The structure also has a window 26 adjacent to the inner periphery.

Also included is an insert 28 selected from the class of inserts including but not limited to wood, glass and polycarbonate. The insert has a generally rectangular configuration with an upper end 30 and a lower end 32 with a pair of side ends 34 there between. The insert has similar yet smaller dimensions than the opening of the structure with none of the dimensions of the opening being more than 0.25 inches than the equivalent dimension of the insert. The insert is adapted to protect the window from debris and other objects tossed around by gusting winds such as those found in a hurricane.

A plurality of anchor clips 36 is also part of the system of the present invention. Each clip is fabricated of a single piece of metal with resilient characteristics and has a pair of end portions 38 and a middle portion 40 with a pair of intermediate portions 42 there between. Each clip also includes a pair of flex lines 44 between each intermediate portion and the middle portion thereby forming an interior region 46 adapted to receive the ends of the insert and held in place under the power of the metal about the flex lines. The end portions each has a generally cylindrical coupling region 48 with a pair of outer cylinders 50 and an inner lip 52 with a pair of openings adjacent and there between. Each outer cylinder has a pair of first coaxial pin apertures 54 running through two sides of the outer cylinder. Each of the intermediate portions also has a pair of bolt apertures 56 running coaxially between the adjacent intermediate portion. The middle portion has four tabs 58 that extend radially from the middle portion with each tab have a second pin aperture 60. Each anchor clip has a resting orientation wherein the end portions are in contact with each other and an open orientation wherein the end portions are separated from each other and with the intermediate portions are parallel to each other against the resilient nature of the metal.

Also part of the system of the present invention are a plurality of sheer pins 62. The shear pins are fabricated of metal and formed in a long narrow configuration configured to include a handle portion 64, a first short end 66 and a second long end 68 with the first short end running coaxial to the second long end and having the handle perpendicular there between. The handle has a pair of sides 70 with a center point 72 there between. The first short end is adapted to couple into the first coaxial pin apertures of the anchor clip and the second long end being adapted to couple into the second pin aperture and into apertures in the edges of the opening in the structure. In this manner, the compressing the sides of the handle together shortens the distance between the first short end and the second long end thereby facilitating insertion.

Lastly, a plurality of locking nuts 74 and bolts 76 are adapted to secure the anchor clip to the insert. The bolts pass through bolt apertures of the anchor clip and then the inserts and then through the coaxial bolt apertures and are held in place with the nuts.

Figure 5:
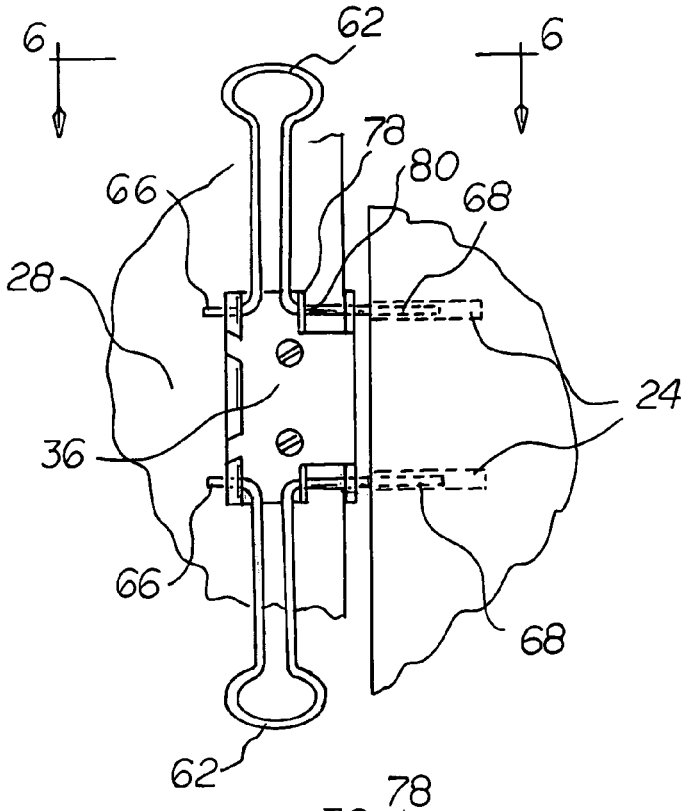
FIG. 5 is end elevational view of an alternate embodiment of the present invention wherein in two pin are used in conjunction with one anchor clip.
Figure 6:
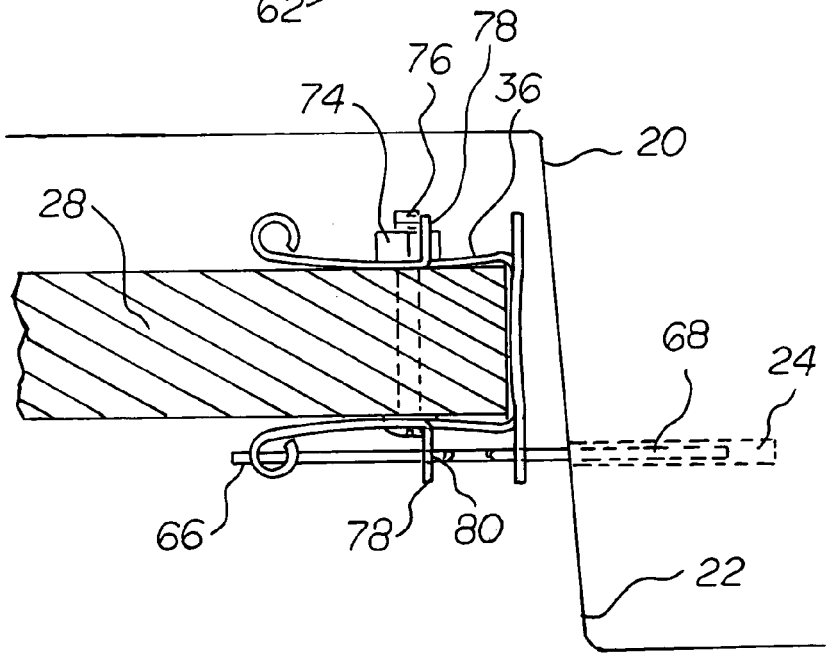
FIG. 6 is cross sectional view of the alternate embodiment taken along line 6-6 of FIG. 5.

In the embodiment of FIGS. 1 through 4, only one shear pin is utilized for each clip. In the embodiment of FIGS. 5 and 6, two shear pins are utilized for each clip. The structures are essentially the same for the two embodiments. Additional holes or apertures 80, located in the tabs 78, however, are required in the clips to support the second shear pins. In this regard, the use of two shear pins per clip is preferred to mount and dismount the clips with respect to the plywood or other insert.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window protection system comprising:

an anchor clip fabricated of a resilient material and having a pair of end portions and a middle portion with a pair of intermediate portions there between, the clip also including a pair of flex lines between each intermediate portion and the middle portion thereby forming an interior region, the end portions each having a coupling region with a pair of outer receivers and inner lips with a pair of openings adjacent there between, the outer receivers each having a pair of apertures, the middle portion having four tabs that extend radially from the middle portion with each tab having a second pin aperture; and a sheer pin including a handle portion with a first short end and a second long end, the handle having a pair of sides with a center point there between.

2. The window protection system as set forth in claim 1 and further including a structure including a generally rectangular opening having plurality of edges, the edges having a plurality of narrow apertures perpendicularly therein.

3. The window protection system as set forth in claim 1 and further including an insert, the insert having a plurality of ends.

4. The window protection system as set forth in claim 3 wherein the insert is made of wood.

5. The window protection system as set forth in claim 1 wherein the anchor clips are formed from a single piece of metal.

6. The window protection system as set forth in claim 1 wherein each of the intermediate portions of the anchor clip also having a pair of bolt aperture running coaxially between the adjacent intermediate portion.

7. The window protection system as set forth in claim 6 and further including a plurality of locking bolts and screws adapted to secure the anchor clip to the insert.

8. The window protection system as set forth in claim 1 wherein the anchor clips are adapted to receive a plurality of pins in the coupling region of the end portions.

9. The window protection system as set forth in claim 1 wherein the anchor clips are adapted to receiver a plurality of pins in the correspond first pin aperture and second pin aperture sets.

10. A window protection system for removably coupling a protective covering over a window comprising, in combination:

a structure including a generally rectangular opening having an upper edge and a lower edge with a pair of side edges there between, the structure also having an inner periphery and an outer periphery, the edges having a plurality of narrow apertures perpendicularly therein adjacent to the outer periphery and the structure also having a window adjacent to the inner periphery;

an insert selected from the class of inserts including but not limited to wood, glass and polycarbonate, the insert having a generally rectangular configuration with an upper end and a lower end with a pair of side ends there between, the insert having similar yet smaller dimensions than the opening of the structure with none of the dimensions of the opening being more than 0.25 inches than the equivalent dimension of the insert, the insert being adapted to protect the window from debris and other objects tossed around by gusting winds of a hurricane;

a plurality of anchor clips, each clip being fabricated from a single piece of metal with resilient characteristics and having a pair of end portions and a middle portion with a pair of intermediate portions there between, each clip also including a pair of flex lines between each intermediate portion and the middle portion thereby forming an interior region adapted to receive the ends of the insert and held in place under the power of the metal about the flex lines, the end portions each having a generally cylindrical coupling region with a pair of outer cylinders and an inner lip with a pair of openings adjacent there between, the outer cylinders each having a pair of first coaxial pin apertures running through two sides of the outer cylinder, each of the intermediate portions also having a pair of bolt apertures running coaxially between the adjacent intermediate portion, the middle portion having four tabs that extend radially from the middle portion with each tab having a second pin aperture, each anchor clip having a resting orientation wherein the end portions are in contact with each other and an open orientation where the end portions are separated from each other and with the intermediate portions are parallel to each other against the resilient nature of the metal;

a plurality of sheer pins fabricated of metal and formed in a long narrow configuration configured to include a handle portion, a first short end and a second long end with the first short end running coaxial to the second long end and having the handle perpendicular there between, the handle having a pair of sides with a center point there between, the first short end adapted to couple into the first coaxial pin apertures of the anchor clip and the second long end being adapted to couple into the second pin aperture and into apertures in the edges of the opening in the structure, whereby compressing the sides of the handle together shortens the distance between the first short end and the second long end thereby facilitating insertion; and a plurality of locking nuts and bolts adapted to secure the anchor clip to the insert, the bolt passing through bolt aperture of the anchor clip and then the insert and then through the coaxial bolt aperture and held in place with the nut.

* * * * *